United States Patent [19]

Kaminski et al.

[11] Patent Number: 4,610,156

[45] Date of Patent: Sep. 9, 1986

[54] PROGRESSIVE DIE APPARATUS HAVING RESILIENT TOOL SUPPORT MEANS

[75] Inventors: Elton G. Kaminski, Sidney; Richard J. Hasselbeck, Houston, both of Ohio

[73] Assignee: The Stolle Corporation, Sidney, Ohio

[21] Appl. No.: 684,708

[22] Filed: Dec. 20, 1984

[51] Int. Cl.[4] ..... B21D 22/02

[52] U.S. Cl. ..... 72/431; 72/465

[58] Field of Search ..... 100/295, 918; 72/465, 72/431, 433, 434; 267/130

[56] References Cited

U.S. PATENT DOCUMENTS

| | | | |
|---|---|---|---|
| 2,979,004 | 4/1961 | Kenville et al. | 72/434 |
| 3,108,502 | 10/1963 | Chatfield | 72/433 |
| 3,426,571 | 2/1969 | Hoffman | 72/465 |
| 4,073,178 | 2/1978 | Dutartre et al. | 72/433 |
| 4,111,024 | 9/1978 | Dahlman et al. | 72/465 |
| 4,377,084 | 3/1983 | Kaminski | 72/465 |

FOREIGN PATENT DOCUMENTS

| | | | |
|---|---|---|---|
| 681274 | 3/1964 | Canada | 72/465 |
| 660754 | 5/1979 | U.S.S.R. | 72/465 |

*Primary Examiner*—Lowell A. Larson

*Attorney, Agent, or Firm*—Frost & Jacobs

[57] ABSTRACT

A resilient tool support for mounting either an upper or lower tooling member on a press ram or stationary press bed for performing a variety of operations on easy open can ends. The resilient tool support comprises a metallic member having a longitudinal central bore with vertically spaced overlying pairs of diametrically opposed angularly oriented segmental slots extending inwardly through the sides of the resilient tool support block reaching the central bore. The resilient tool support may be positioned between either the press ram and the upper tooling member, or the stationary press bed and the lower tooling member. The resilient tool support is designed to yield and absorb excessive pressure of the press ram as it performs the various operations on the easy open can ends.

13 Claims, 33 Drawing Figures

PROGRESSIVE DIE APPARATUS HAVING RESILIENT TOOL SUPPORT MEANS

BACKGROUND OF THE INVENTION

1. Field of the Invention

The present invention relates to a plurality of tooling operations for forming pull tab easy open can ends. In particular, the present invention concerns the employment of a resilient tool support means mounted either between the press ram and an upper tool member, or between a lower tool member and the support bed. The resilient tool support means controls the penetration and clearance of the tooling in the closed position.

2. Prior Art

In the early days of easy opening can end production, it was recognized that the control of the movable ram mounted tooling in the true closed position was absolutely necessary in order to control remaining metal thickness, particularly in the scoring operation. Attempts were made to permit the scoring tool to project the correct distance so that the remaining metal, after the scoring operation, would be within the desired range of thicknesses. There were two problems with this technique, namely, metal gauge thicknesses were not as tightly controlled in the early days as compared to the present, and tight metal clamping. For example, if heavier gauge metal were employed in the scoring operation, a greater thickness of the remaining metal would result after the scoring operation, thus making the end of the easy open cans difficult to open. Conversely, thinner gauge thicknesses would be scored too deeply such that the cans would leak through the scored area, particularly when filled with carbonated beverages under pressure. Additionally, if the metal blank is clamped too tightly by the press, the metal will be unable to properly shift during scoring, resulting in small fractures in the remaining metal.

In order to avoid the problems of tight metal clamping and uncontrolled metal thicknesses, the invention set forth in U.S. Pat. No. 4,377,084 discloses scoring press apparatus having resilient stop blocks. In particular, this reference discloses typical press apparatus with a pair of resilient stop blocks mounted upon the stationary press floor. Atop each of the resilient stop blocks is a solid stop block which extends upwardly to the press ram. The resilient stop blocks progressively remove inherent clearances in the press in order to accurately determine the thickness of the remaining or residual metal which serves to firmly secure the scored element to the metallic sheet.

Because the arrangement of the stop blocks enabled the press to accurately determine the thickness of the residual metal, the press was capable of scoring different thicknesses of metallic sheet so that the residual metal remained a constant thickness. Although this device performed well, it was recognized that more precise control of the ram in the closed position was absolutely necessary for present needs employing thinner metallic sheets or blanks, to control the depth of penetration and the remaining metal thickness.

Presently, base metal gauge thicknesses have been more uniform such that a total variation from nominal thicknesses does not exceed ±0.0004 inches. This variation permits the use of new tooling techniques, including the use of a resilient tool support means, for a plurality of tooling operations, which is the subject of the present invention.

SUMMARY OF THE INVENTION

The present invention is directed to a resilient tool support means positioned between the press ram and an upper tool member, or between the press support bed and a lower tool member. The resilient tool support means controls the depth of penetration of the upper and lower tool members into a metallic blank, yet prevent excessive penetration. Thus, while the inventive concept of U.S. Pat. No. 4,377,084 focuses on the remaining metal thickness, the inventive concept of the present invention focuses on the depth of penetration so that a variety of tooling operations, other than just scoring, may be performed.

The operational characteristics and the function of the resilient elements of U.S. Pat. No. 4,377,084 and the present invention are also different. The resilient stop blocks of the above-noted U.S. patent would cause further penetration if the press continued "loading" the metallic blank. On the other hand, the resilient support means of the present invention will give and absorb any continued "loading" without causing further penetration by either the upper or lower tool member.

The resilient tool support means is formed of metal into many shapes such as circular, square, or polygonal. Each support means includes either slots or axial annular grooves cut in the side wall in order to provide a resiliency to the support means. For example, the slots may be arcuate in shape if the resilient tool support means is circular, or rectangular in shape if the tool support means is square shaped. Each support means generally includes a central bore which provides additional resiliency to the tool support means. Optionally, each central bore may include a stop member which prevents the resilient tool support means from being overstressed to the point of collapsing. Additionally, the resilient tool support means includes a flange extending laterally from one end thereof. The flange includes means for mounting the resilient tool support means, such as studs and openings through which bolts can securely fasten the resilient tool support means.

In a typical operation of the present invention, a metallic blank is introduced between an upper tool member and a lower tool member, which are in the open, spaced-apart position. The press ram advances the upper tool member toward the lower tool member in order to perform a variety of tooling operations such as rivet forming, paneling, scoring, embossing, tab securing, or final staking. After performing a tooling operation, the press ram retracts until the upper tool member and lower tool member are once again in the open, spaced-apart position. The metallic blank is removed from the press and transported to the next successive tooling operation until an easy open can end is completely formed. As one metallic blank leaves a tooling operation, another metallic blank is introduced therein, thus continuously repeating the entire easy open can end manufacturing process.

DETAILED DESCRIPTION OF THE INVENTION

Figure 1A:
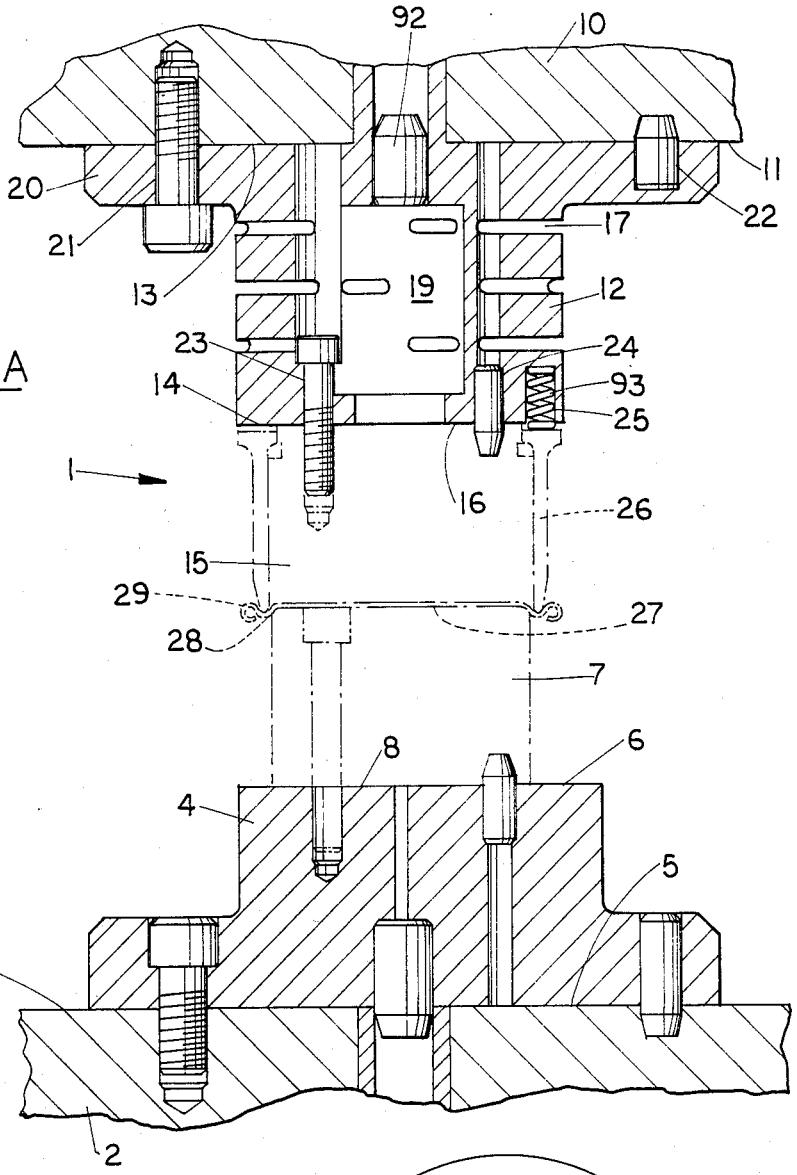
FIG. 1A is a cross-sectional side view illustrating the press ram of the present invention, including the resilient tool support means, ram, upper and lower tool members, a support tool base and a stationary press bed.

FIG. 1 illustrates a conventional press generally indicated by reference numeral 1, having a stationary press bed 2 including a generally planar horizontal upper surface 3. Surface 3 supports a tooling base 4 which has a planar bottom surface 5 and a planar upper surface 6. Positioned upon the upper surface 6 of tooling base 4 is a lower tooling member 7 which may take a variety of shapes depending upon the tooling operation to be performed. However, each lower tooling member has a planar bottom surface 8 which mates with the upper surface 6 of the tooling base 4 to provide secure support for the lower tooling member 7.

A vertically displaceable press ram 10 overlies press bed 2 and includes a generally planar horizontal lower surface 11. Surface 11 of the press ram 10 supports a resilient tool support means 12 which may take a plurality of shapes depending upon the type selected for a particular tooling operation. In general, however, the resilient tooling base 12 includes an upper planar surface 13 which provides solid mating contact with the surface 11 of the press ram 10 so that the resilient tool support means 12 is securely fastened to the press ram 10. Moreover, each resilient tool support means includes a lower planar surface 14 as shown in FIG. 1. The resilient tool support means 12 securely supports an upper tooling member 15 having an upper planar surface 16 in mating contact with the lower planar surface 14 of the resilient tool support means 12. The upper tooling member 15 can be one of many shapes and sizes depending upon the particular tooling operation to be performed.

The present invention particularly concerns the resilient tooling base 12 located between the press ram 10 and the scoring punch holder 15, as illustrated in FIG. 1. However, the tooling base 4 may be interchangeable with the resilient tool support means 12, so that the resilient tool support means 12 may be positioned between the stationary press bed 2 and the lower tooling member 7 as illustrated in FIG. 2A, for example. Although the resilient tool support means 12 may take a plurality of shapes, in general each resilient tool support means includes features common to all shapes. Specifically, each support means 12 includes either slots 17 (see FIG. 1A) or radial grooves 18 (see FIG. 11) cut in the side wall in order to provide resiliency to the support means 12. Additionally, each support means includes a central bore 19 which provides additional resiliency. Lastly, each support means 12 includes a flange 20 for mounting the support means on a press ram 10 or stationary press bed 2. Each support means 12 includes openings 21 and recessed orifices 22 in the flange 20 for securing the support means 12. Likewise, the planar surface 14 includes openings 23 for bolts, stud openings 24 and recessed apertures 25 for spring biasing the centering ring 26. Finally, note that each tooling base 4 has openings, orifices and apertures in the same locations as those in the resilient tool support means 12, to enable one to be interchangeable with the other.

The various types of tooling operations to be performed in succession include bubble forming in the center of the open can lid, forming the bubble into a button, scoring an opening for the easy open can end, paneling the easy open can end in the area surrounding the scored opening and the area where the pull tab will be positioned, staking the pull tab to the easy open can end by positioning the pull tab in the panel area so that the button of the can end projects through the rivet hole of the pull tab, thereby permitting the button to be compressed so as to form a rivet to retain the pull tab, and stamping incise lettering upon the easy open can end for setting forth messages such as "lift up, pull back" or "dispose of properly".

Figure 1B:
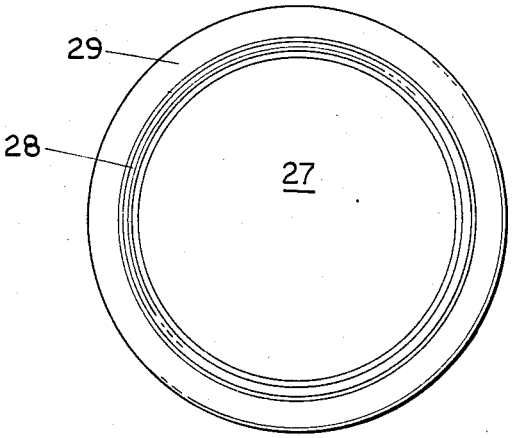
FIG. 1B is a plan view of a easy open can end after the can end has been initially stamped from sheet material and formed with an annular groove and rim.
Figure 2A:
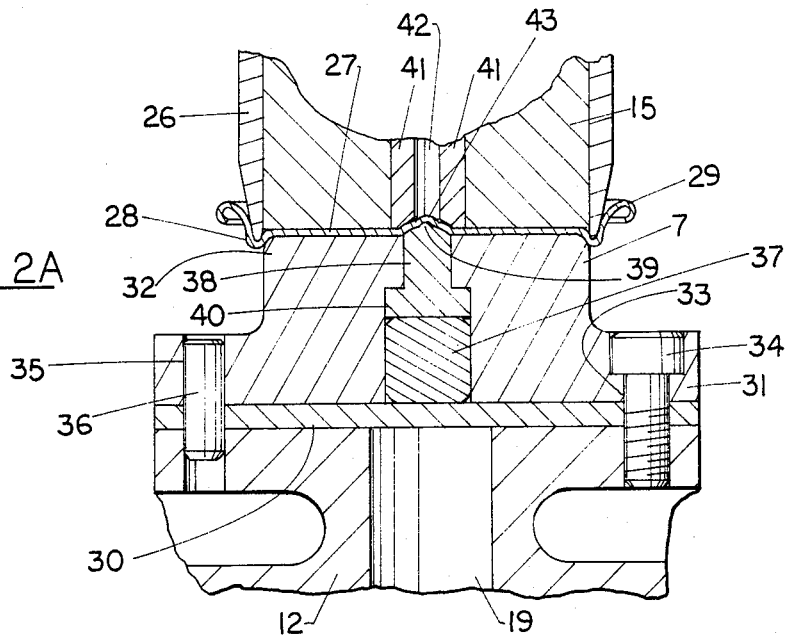
FIG. 2A is a cross-sectional side view illustrating the upper and lower tool members necessary to form a centrally located bubble in the easy open can end.

FIG. 1B illustrates an easy open can end 27 before any of the operations of the present invention have been performed thereon. As shown in FIG. 1B, the easy open can end has been stamped from a metallic sheet, formed with an annular groove 28 adjacent its periphery thereof, and provided with an annular rim 29 on the outermost edge of the annular groove 28.

FIG. 2A illustrates the first operation performed on the easy open can end illustrated in FIG. 1B. As shown in FIG. 2A, the resilient tool support means 12 is shown mounted upon the stationary press bed (not shown). The resilient tool support means 12 has a plate support member 30 mounted upon its top surface to support the lower tooling member 7. The lower tooling member 7 has a flanged area 31 and a thickened central portion 32. The flanged area 31 includes a plurality of holes 33, (one of which is shown) for bolts 34 and openings 35 for studs 36 for securing the lower tooling member 7 to the spacer member 30 and the resilient tool support means 12. The central thickened area 32 of the lower tooling member 7, includes an insert adjustment spacer 37 which supports the punch 38. The punch 38 has a generally rounded head 39 which contacts the metallic easy open can end 27 and a flanged area 40 which contacts the insert adjustment spacer 37. As the rounded head 39 of the punch wears out, a larger insert adjustment spacer 37 may be necessary. Additionally, the depth of penetration of the punch on the easy open can end 27 is also determined by the insert adjustment spacer 37. It is now evident that the plate support member 30 supports not only lower tooling member 7 but also prevents the insert adjustment spacer 37 from falling through the central bore 19 of the resilient tool support means 12.

Figure 2B:
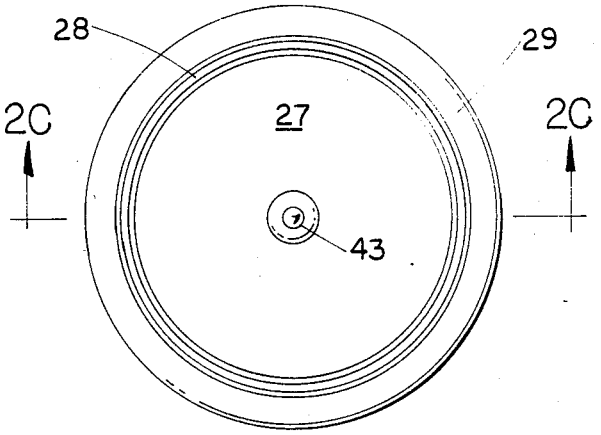
FIG. 2B is a plan view illustrating the bubble formed in the easy open can end.

As illustrated in FIG. 2B, the upper tooling member 15 is surrounded by a centering ring 26 which acts to center the easy open can end 27 so that the bubble operation may be performed in the exact center of the easy open can end. The upper tooling member 15 is supported on a support means (not shown), which in turn is supported or suspended from the press ram (not shown) by a plurality of bolts and studs, similar to those illustrated in FIG. 1. The upper tooling member 15 includes a hollow die member 41 having a central longitudinal orifice 42. The die 41 aids in forming the bubble 43 on the easy open can end 27.

Figure 2C:
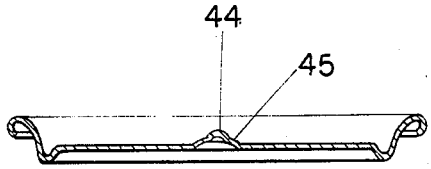
FIG. 2C is a cross-sectional side view of the easy open can end illustrating the bubble formed therein, taken along line 2C—2C of FIG. 2B.

In the first operation of the bubble tooling procedure, the easy open plain can end of FIG. 1B is subject to the tooling illustrated in FIG. 2A which raises a rivet preform or bubble 43, from the central flat surface of the easy open can end. While some coining of the bubble side wall usually takes place during formation, it is generally desirable to maintain the top of the bubble as thick as possible. The formed bubble 43, shown in FIG. 2B, consists of a rounded cone shaped head 44, as further illustrated in FIG. 2C, and a truncated base portion 45 whose side tapers upwardly at a lesser slope than the side wall of the cone head 44 of the bubble 43.

Figure 3A:
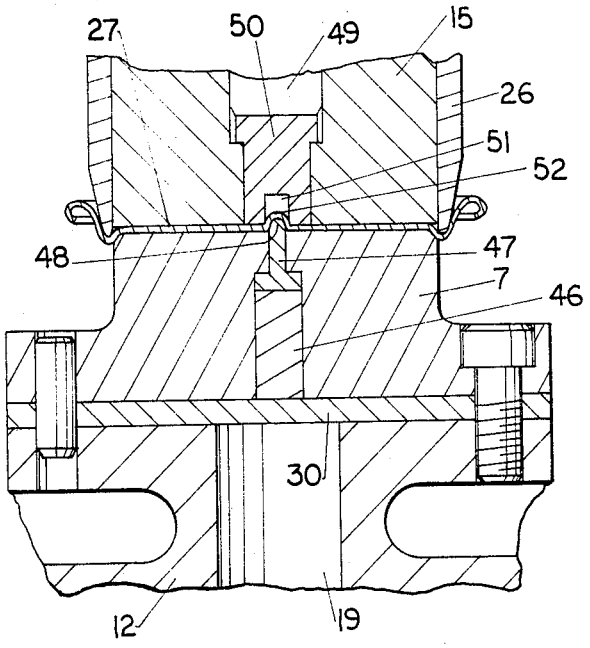
FIG. 3A is a cross-sectional side view illustrating the upper and lower tooling members for forming a button from the bubble in an easy open can end.
Figure 3B:
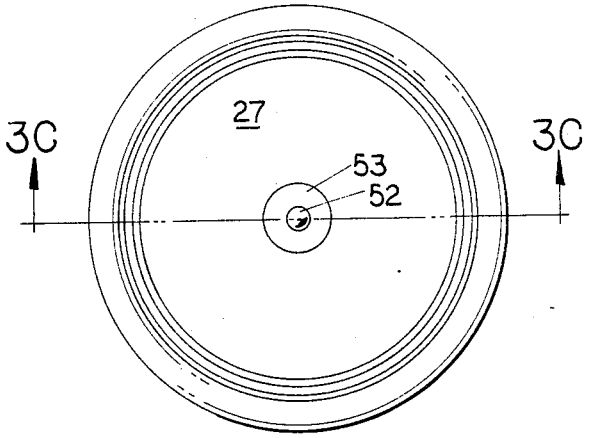
FIG. 3B is a plan view illustrating the easy open can end having a button centrally located thereon.
Figure 3C:
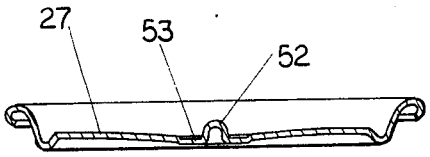
FIG. 3C is a cross-sectional side view taken along line 3C—3C of FIG. 3B showing the button formed thereon.

In the second tooling operation, illustrated in FIGS. 3A, 3B and 3C, the bubble formed in the first operation is formed into a button. The bubble is reformed into a button to create the "shank" of the rivet. Coining at the base of the rivet is included in order to raise the rivet to the correct height.

In this operation, the lower tooling member 7, show in FIG. 3A, includes an insert adjustment spacer 46 and a punch 47 having a rounded head 48. This insert adjustment spacer 46 and punch 47 are smaller in size than the punch 38 and insert adjustment spacer 37 illustrated in FIG. 2A. Like the device shown in FIG. 2A, a support member plate 30 is necessary to support the lower tooling member 7 and to prevent the insert adjustment spacer 46 from dropping into the central bore 19 of the resilient tool support means 12.

The upper tooling member 15 has an upper button adjustment spacer 49 and a circular die 50 having a central recess portion 51 which is much narrower in diameter than the "diameter" of the bubble 43.

In operation of the button forming tooling operation a metallic blank having a bubble 43 formed therein is centrally located between the upper and lower tooling members 15 and 7, respectively, by means of the centering ring 26. The press ram (not shown) forces the upper tooling member 15 down upon the metallic easy open can end 27 which is supported upon the lower tooling member 7. As the press 10 (not shown) advances toward the stationary press bed 2 (not shown), the bubble 43 is reshaped or reformed into a button or rivet 52 as illustrated in FIGS. 3B and 3C.

As illustrated in FIGS. 3B and 3C, the rivet 52 includes a recessed portion 53 adjacent its periphery which is flat and completely surrounds the actual rivet or button 52.

Figure 4A:
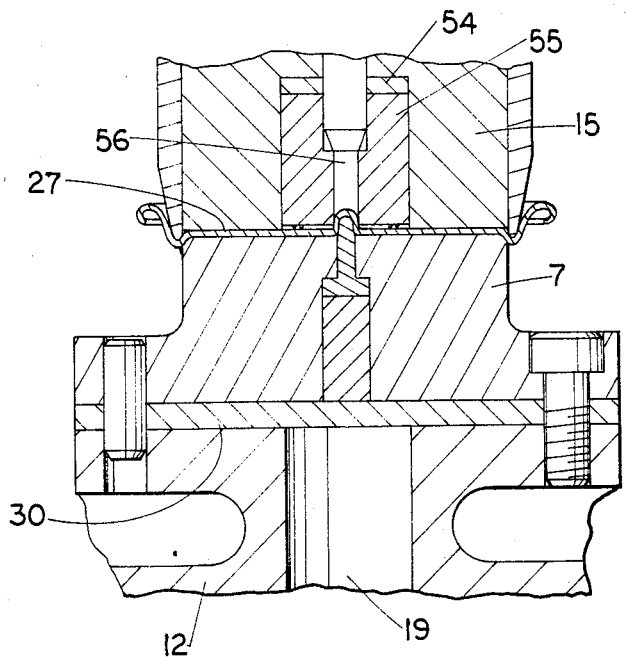
FIG. 4A is a cross-sectional side view illustrating the upper and lower tool members necessary for performing a scoring operation on an easy open can end.
Figure 4B:
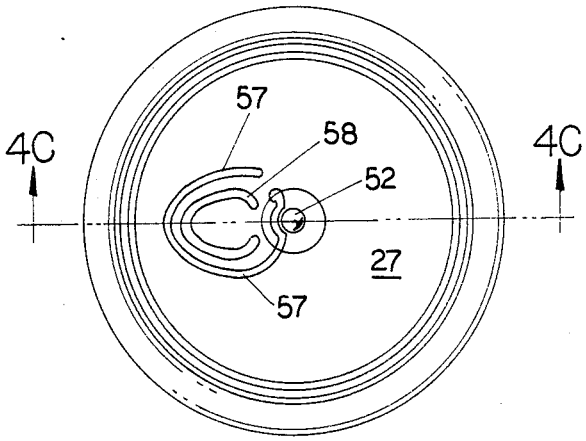
FIG. 4B is a plan view of an easy open can end in which an opening has been scored thereon.
Figure 4C:
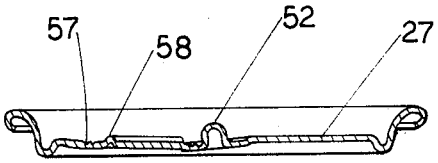
FIG. 4C is a cross-sectional side view taken along line 4C—4C of FIG. 4B, illustrating the scored easy open can end shown in FIG. 4B.

In the third tooling operation procedure, shown in FIGS. 4A, 4B and 4C, the easy open can end is scored to form the future opening of the easy open can end. Some embossments and debossments may be included in this area to provide additional mechanical support for the opening shape.

As shown in FIG. 4A, the lower tooling member 7 is substantially similar to the lower tooling member illustrated in FIG. 3A. However, the upper tooling member 15 illustrated in FIG. 4A is substantially different and includes an upper insert adjustment spacer 54 which determines the depth of penetration of the scoring punch 55. As is clear from FIG. 4A, the scoring punch 55 includes a centrally located longitudinal aperture 56 into which the button 53, illustrated in FIG. 3A, projects.

The scored easy open can end is shown in FIG. 4B. The easy open can end shows the scored openings 57 and embossments 58 to provide mechanical strength to the opening of the easy open can end. When embossments are employed, the lower tooling member 7 is slightly different than that illustrated in FIG. 4A in that its upper surface which supports the can end 27, includes raised projections to form the embossments. As clearly shown in FIG. 4C, the button is not altered by the scoring process illustrated in FIG. 4A.

In the scoring operation, a metallic can end having a button 52 formed therein is inserted between the upper and lower tooling members 15 and 7, respectively. The press ram (not shown) forces the upper tooling member 15 down upon the easy open can end 27 supported on the lower tooling member 7. As the press advances to the closed position, the can end 27 is scored and, if desired, embossed.

The next tooling operation is the paneling procedure. The paneling operation provides a downward debossment in the can end which provides a tab recess and increases the buckle resistance to internal pressure. Additionally, the adjacent area around the opening of the easy open can end is also paneled to provide mechanical strength to the area of the easy open can end, particularly after the can has been opened.

Figure 5A:
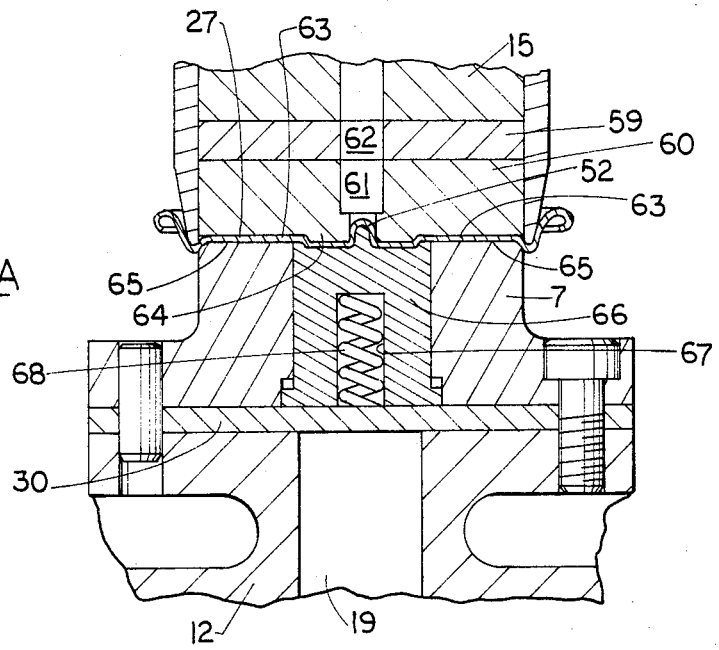
FIG. 5A is a cross-sectional side view illustrating the upper and lower tooling members for performing the paneling operation on an easy open can end which has just been scored.

As illustrated in FIG. 5A, the upper and lower tooling members 15 and 7, respectively, are substantially different from those employed in the scoring operation. The upper tooling member 15 includes an upper panel insert adjustment spacer 59 for determining the depth of paneling on the top surface of the easy open can ends 27. This spacer is substantially the same cross-sectional diameter as the upper tooling member 15 because the upper tooling member die 60 contacts substantially the entire surface area of the can end. Also, both the upper panel insert adjustment spacer 59 and the die 60 include a centrally located aperture 61 and 62, in alignment with one another, so as to provide a space for the button 52 to project into during the paneling operation. Die 60 has a thin portion 63 which surrounds the panel forming area 64 that is thicker so as to project further into a can end.

The lower tooling member 7 has a peripheral surface 65 which is at a higher elevation than the central portion 66. The central portion 66 mates with the panel forming area 64 of die 66, while the thin portion 63 mates with the peripheral surface 65, in the closed position. A recessed opening 67 in the central portion 66 of the lower tooling member 7 is provided with a spring 68 which functions to lift the central portion 66 upwardly from the plate support 30 before the paneling operation begins. In this manner, the depth of paneling is controlled by the height of the central portion 66 and the resiliency of the spring 68 located therein. Plate 30 prevents spring 68 from falling into central bore 19 of the resilient tool support means 12.

Figure 5B:
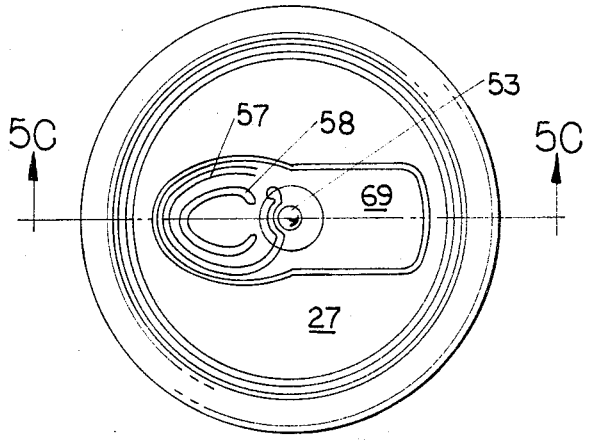
FIG. 5B is a plan view of an easy open can end illustrating the paneling stamping.
Figure 5C:
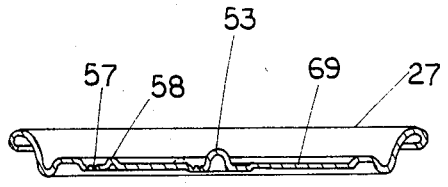
FIG. 5C is a cross-sectional side view taken along line 5C—5C of FIG. 5B, illustrating the easy open can end of FIG. 5B.

As illustrated in FIG. 5B, the paneling operation has been performed on an easy open can end producing a recessed paneled area 69 surrounding the scored opening 57 and the button 53. As illustrated in FIG. 5C, the button has not been reduced in size.

In operation of the paneling procedure, a metallic can end having a scored opening formed therein is inserted between the upper and lower tooling members 15 and 7, respectively. The press ram (not shown) forces the upper tooling member 15 down upon the easy open can end 27. As the press advances to the closed position, the can end 27 is paneled.

Figure 6A:
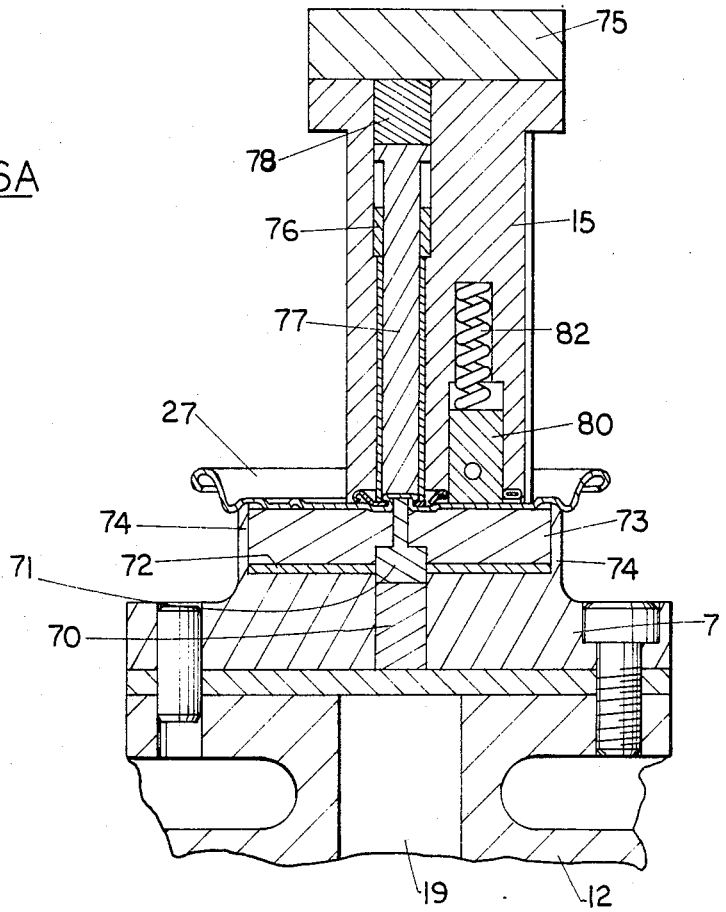
FIG. 6A is a cross-sectional side view illustrating the upper and lower tooling members for staking a pull tab onto the easy open can end.
Figure 6B:
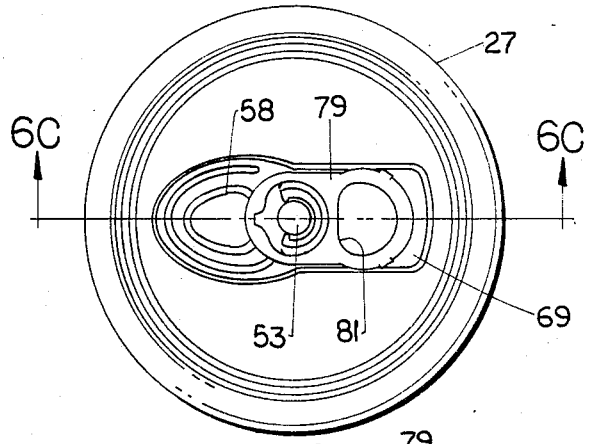
FIG. 6B is a plan view of an easy open can end showing a staked pull tab on an easy open can end.
Figure 6C:
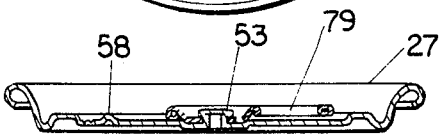
FIG. 6C is a cross-sectional side view taken along line 6C—6C of FIG. 6B illustrating the easy open can end of FIG. 6B.

FIGS. 6A, 6B and 6C illustrate the tooling for the staking process and the staked can end. In the staking process, a pull tab is positioned within the panel portion of the easy open can end so that the button or rivet projects through the rivet or pivot opening. The downstroke of the upper punch "squeezes" the top of the rivet between the upper staking punch and the lower staking anvil. This squeezing action thins the metal in the top of the rivet causing radically outward movement to create the rivet head, thus holding the pull tab in place.

As illustrated in FIG. 6A, a plate support 30 is positioned between the resilient tool support means 12 and the lower tooling member 7 to prevent the lower staking adjustment spacer 70 from falling into the central bore 19 of the resilient tool support means 12. In addition to the adjustment spacer 70, the lower tooling member 7 includes a small anvil 71 to prevent the rivet from being driven downwardly through the metallic easy open can end 27, and a second adjustment spacer 72, which adjusts the height of the primary anvil 73. The primary anvil 73 provides support for the metallic easy open can end 27 in the area surrounding the rivet or button 53. Moreover, the lower tooling member includes an integral, annular, peripheral support ring 74 which surrounds the primary anvil 73 and supports the periphery of the easy open can end 27.

The upper tooling member 15 includes a solid spacer 75 at the upper end thereof. An adjustment spacer 76 is provided between the staking punch 77 and the primary adjustment spacer 78. The staking adjustment spacer 76 determines the degree to which the rivet is flattened or squeezed outwardly in order to retain the pull tab on the easy open can end. Primary adjustment spacer 78 functions to assure that the staking punch 77 does stake the pull tab 79 to the can end 27. Additionally, the upper tooling member is provided with a position dowel 80 which is designed to fit within the circular finger opening 81 (see FIG. 6B) of the pull tab 79. The dowel 80 is spring loaded by means of spring 82 so that it holds the pull tab 79 in position while the staking punch 77 flares the button rivet 53 outwardly (as shown in FIG. 6C) to secure the pull tab 79 to the easy open can end. This operation does not include the use of a centering ring because the can end 27 will be properly positioned once the button or rivet 53 projects through the rivet hole of the pull tab and the position dowel 80 securely positions the pull tab.

In operation of the staking process, a can end is inserted between the upper and lower tooling members 15 and 7, respectively. The press ram (not shown) forces the upper tooling member 15 down upon the can end 27. As the press advances to the closed position, the pull tab 79 is staked to the can end 27.

Figure 7A:
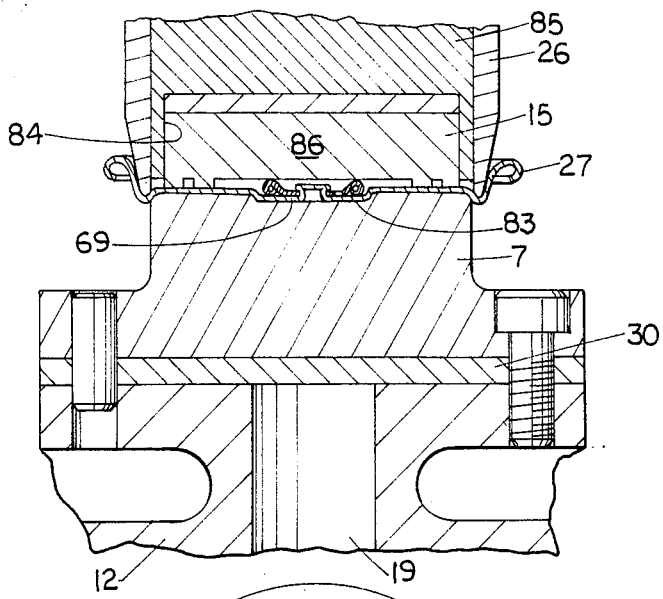
FIG. 7A is a cross-sectional side view illustrating the upper and lower tooling members necessary for performing incise lettering on an easy open can end which has been staked with a pull tab.
Figure 7B:
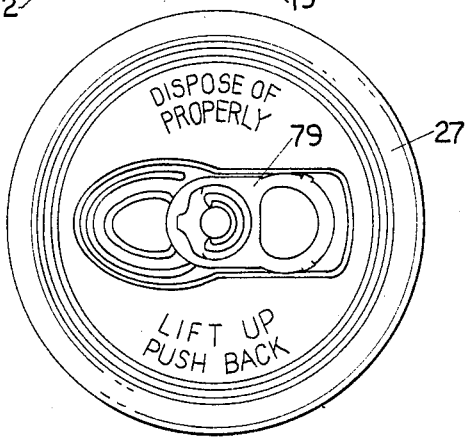
FIG. 7B illustrates a plan view of an easy open can end showing the incise lettering stamped thereon.

The last step of the tooling operation illustrated in FIG. 7A includes the process of incise lettering the easy open can end. For example, most easy open can ends are stamped with the phrase "dispose of properly" or "lift up, pull back" as illustrated in FIG. 7B.

As illustrated in FIG. 7A, the lower tooling member 7 is provided with a central recess portion 83 which mates with the paneled section 69 of the easy open can lid 27 when properly positioned upon the lower tooling member. Although a plate support 30 is shown positioned between the lower tooling element 7 and the resilient tool support means 12, this plate may be eliminated in this operation because it is not necessary to prevent an element of the lower tooling member 7 from falling into the central bore 19 of the resilient tool support means 12. Additionally, the thickness of the spacer can be made up by merely having the press ram continue its downward stroke an incremental distance corresponding to the thickness of the plate support, or by increasing the thickness of the lower tooling member 7.

The upper tooling member 15 includes a centrally located recessed cavity 84 into which an adjustment spacer 85 is positioned along with the die 86 for the incise lettering. Consequently, the thickness of the adjustment spacer 85 determines the depth to which the lettering is stamped on the easy open can end 27.

While the tooling operations described herein are set forth in a specific sequence, the sequence of the steps may be in any order. However, certain steps must be performed ahead of other steps. Namely, the bubble operation must be performed sometime before the button procedure, and both these steps must be performed before the staking operation or the pull tab will have no rivet to retain it. Moreover, the paneling operation must occur before the staking operation or the pull tab will be forced into the can end.

The tooling operations required to form the easy open can end are not novel per se. However, the particular apparatus employed in carrying out the operation is the novel concept of the present invention. In particular, the incorporation of a resilient tool support means in each of the operations to control the accuracy of the operations by using the depth of penetration as the control instead of the operational accuracy of the press is the nexus of the present invention.

Figure 8:
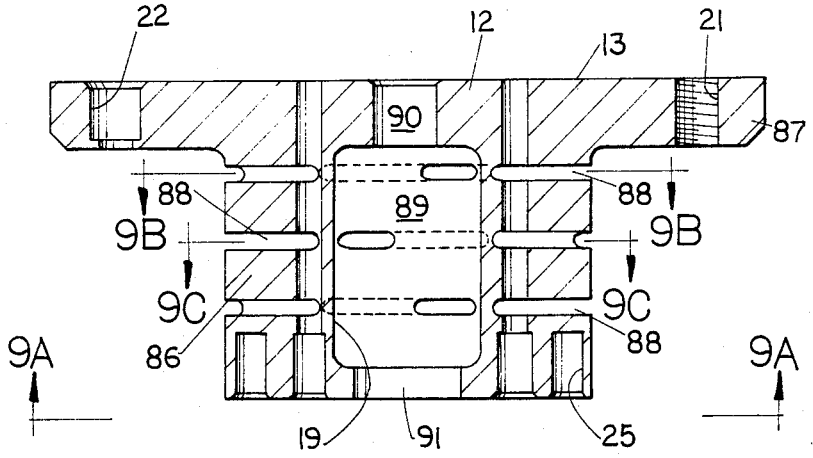
FIG. 8 is a cross-sectional side view of a resilient tool support means of the present invention.

FIG. 8 illustrates one embodiment of the resilient tool support means 12 of the present invention. The resilient tool support means includes a generally cylindrical base portion 86 and an integrally formed flange 87 which has a larger diameter than the base portion.

The base portion 86 is provided with vertically spaced overlying pairs of diametrically opposed segmental slots 88 extending inwardly through the sides of the base portion 86 into the central bore 19. The segmental slots 88 permit the deformation of the resilient tool support means in order to obtain accurate depth penetration by the upper and lower tooling members into the can end. The central bore 19 consists of a large centrally located cylindrical cavity 89, a smaller diameter cavity 90 extending from the top surface 13 of the resilient tool support means to the large cavity 89 and an intermediate diameter cavity 91 extending from the bottom 14 of the base portion 86 to the large cavity 89. Each cavity is axially aligned with one another along the longitudinal center line of the resilient tool support means.

Figure 9A:
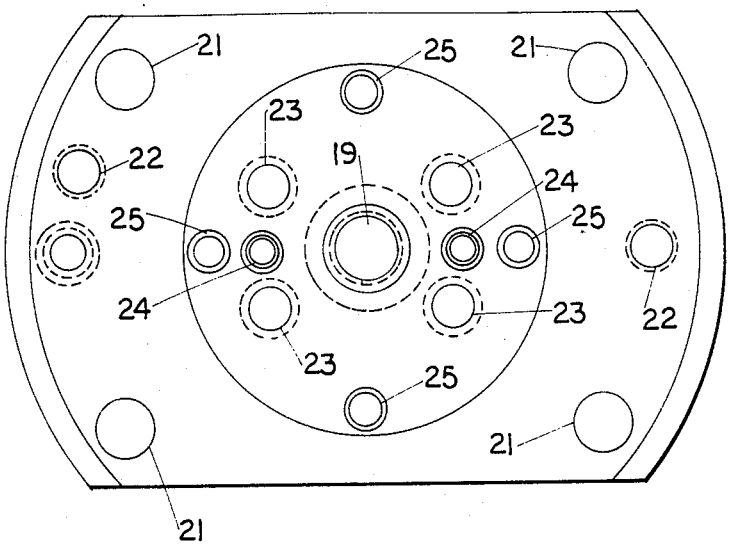
FIG. 9A is a bottom view of the resilient tool support means taken along line 9A—9A of FIG. 8.

As best shown in FIGS. 8 and 9, the flange 87 has one or more stud orifices 22 which accommodate a stud, as best seen in FIG. 1A, to assure accurate positioning of the resilient tool support means with respect to the press ram 10 or the stationary press bed 2 of the present apparatus. In addition to the stud orifices, the flange has one or more openings 21 adapted to accommodate a bolt, which is best viewed in FIG. 1A, to securely mount the resilient tool support means to either the press ram or the stationary press bed. The stud orifices 22 may either carry the studs or receive the studs from the surrounding tooling in contact with the resilient tool support means. Also, the central bore 19 is designed to accomodate a stud 92 (see FIG. 1A) in the small diameter 90 of the central bore 19. This stud 92 projects into the press ram 10 or stationary press bed 2 in much the same manner as the studs located in the periphery of the flange. Accordingly, the studs in the periphery of the flange and the center stud insure proper alignment between the resilient tool support means and the press ram or stationary press bed.

As best illustrated in FIGS. 1A, 8 and 9, the resilient tool support means 12 has in its circular base portion 86 a plurality of orifices 25 for housing spring means 93 which bias the center ring 26 as illustrated in FIG. 1A. The orifices 25 extend between the bottom 14 of the resilient tool support means 12 to approximately the bottommost arcuate slot 88 as shown in FIG. 8. Radially inward from the orifices 25 are a plurality of apertures 23, one pair of which is positioned on one side of the central bore 19 and another pair of which is positioned on the opposite side, as best shown in FIG. 9. The apertures 23 extend through the entire height of the resilient tool support means and serve as bolting apertures for fastening the resilient tool support means 12 to either the upper or lower tooling member. The bolts are substantially recessed into the apertures 23 so that the heads of the bolt are approximately level with the bottommost arcuate slot 88 as best illustrated in FIG. 1A. Between each pair of apertures 23 resides a bore 24 which extends through the entire height of the resilient tool support means, as best illustrated in FIG. 9. The two bores 24 positioned between the pairs of aperturès 23 are designed to house studs, one of which is illustrated in FIG. 1A. The studs serve to align the resilient tool support means with the upper tooling member 15.

Figure 9B:
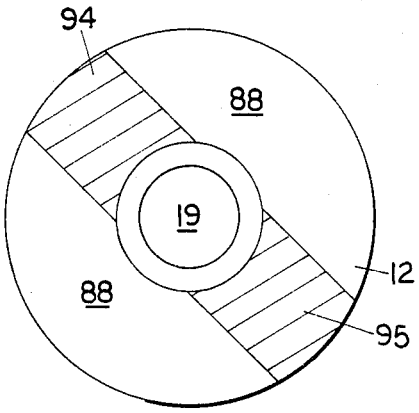
FIG. 9B is a cross-sectional top view taken along line 9B—9B of FIG. 8.
Figure 9C:
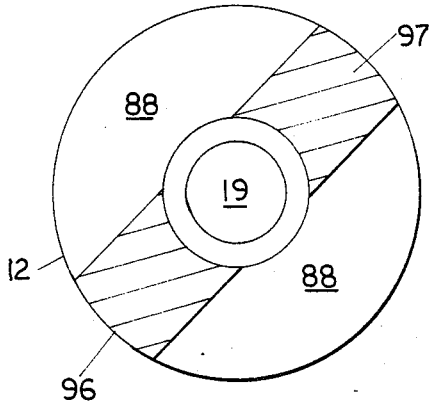
FIG. 9C is a cross-sectional top view taken along line 9C—9C of FIG. 8.

FIGS. 9B and 9C show the arcuate slots 88 cut into the side wall of the resilient tool support means 12. After the slots are cut into the side wall, two portions 94 and 95 remain in FIG. 9B, and two portions 96 and 97 remain in FIG. 9C. Portions 94 and 95 are in alignment with one another as are portions 96 and 97. However, portions 94 and 95 are perpendicularly positioned with respect to portions 96 and 97.

Although none of the FIGS. 2A, 3A, 4A, 5A, 6A, and 7A illustrate means which secure either the upper or lower tooling member to their respective apparatus, note that each of the upper and lower tooling members include a combination of studs and bolts such as those shown in FIG. 1A, which serve to firmly secure both the upper tooling member and the lower tooling member to their respective apparatuses.

Figure 10:
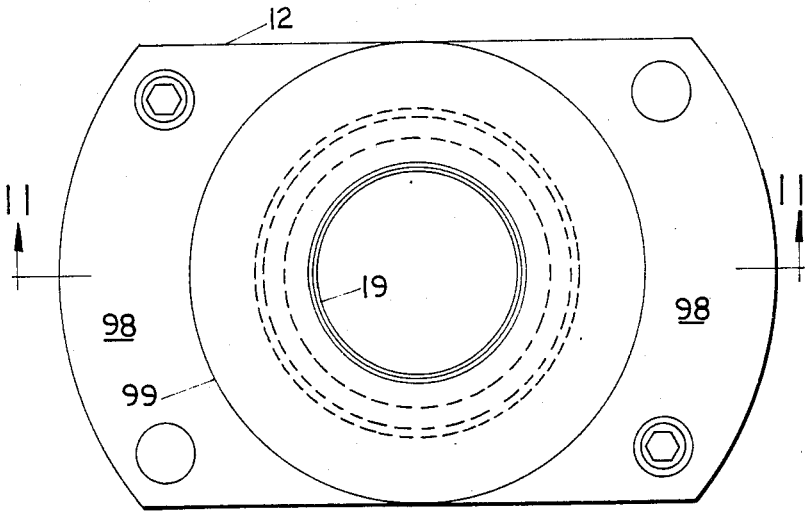
FIG. 10 is a plan view of a different embodiment of the resilient tool support means.
Figure 11:
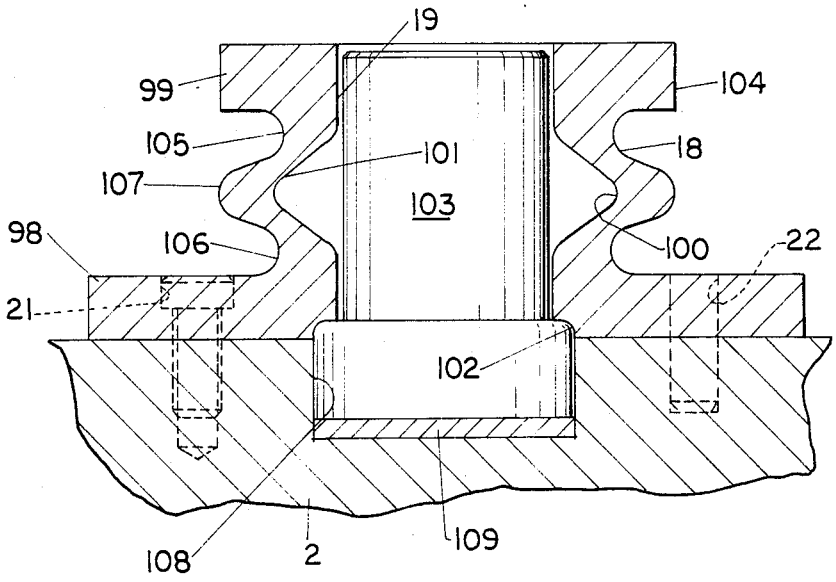
FIG. 11 is a cross-sectional side view of the resilient tool support means taken along line 11—11 of in FIG. 10.

FIGS. 10 and 11 illustrate another resilient tool support means 12 of the present invention. Like the resilient tool support means illustrated in FIGS. 8 and 9, this resilient tool support means has a flange 98 and a base portion 99 which acts as a spring. Additionally, the resilient tool support means 12 includes a central bore 19, however, the central bore 19 is not formed or shaped in the same manner as the resilient tool support means shown in FIG. 8. The central bore 19 is largely of a uniform diameter except near the center 100 of the bore. In this region, a radial groove 101 has been cut into the inner side wall of the central bore 19. Additionally, the central bore 19 has an end 102 adjacent either the press ram or the stationary press bed. The end 102 is slightly enlarged to accommodate a positive stop 103.

The outside wall 104 of the resilient tool support means includes two vertically spaced apart undercut grooves 105 and 106 cut therein. The portion 107 on the outside wall between the two radial undercut grooves 105 and 106 is in alignment with the radial groove 101 cut into the inside side wall of the central bore 19. In this manner, the thickness of the side wall from groove to groove remains somewhat constant in thickness. Of course, by varying the thickness of the side wall, the spring constant for the resilient tool support means can be modified.

When using the resilient tool support means 12 illustrated in FIGS. 10 and 11, the press ram (not shown) or the stationary press bed 2, which is in mating contact with the resilient tool support means includes a recessed area 108 corresponding in diameter to the outwardly diverging end 102 of the central bore 19. The recessed area 108 along with the central bore 19 of the resilient tool support means is adapted to house a positive stop 103 which permits the resilient tool support means 12 to yield under certain loads, but yet prevents the resilient tool support means from totally collapsing. Additionally, the deflection may be adjusted by placing a spacer 109 in the recessed area 108 between the positive stop 103 and the press ram (not shown) or stationary press bed 2.

As can be seen in FIG. 11, the flange area 98 of the resilient tool support means 12 of FIG. 10 includes holes 21 and apertures 22 for bolts and studs located in the same position as the openings and apertures for the bolts and studs of the resilient tool support means shown in FIG. 9.

Figure 12:
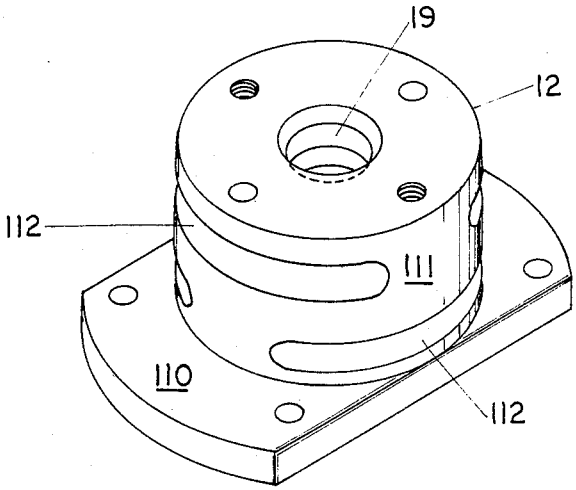
FIG. 12 is an upper perspective view of yet another embodiment of a resilient tool support means.
Figure 13:
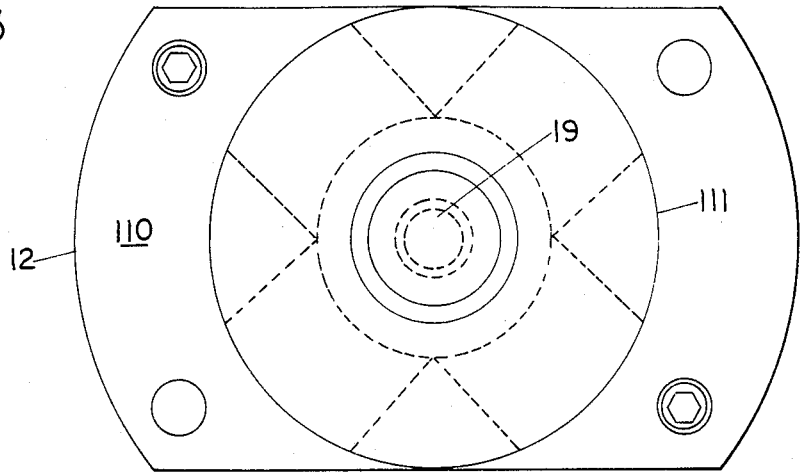
FIG. 13 is a plan view of the resilient support means of FIG. 12.
Figure 14A:
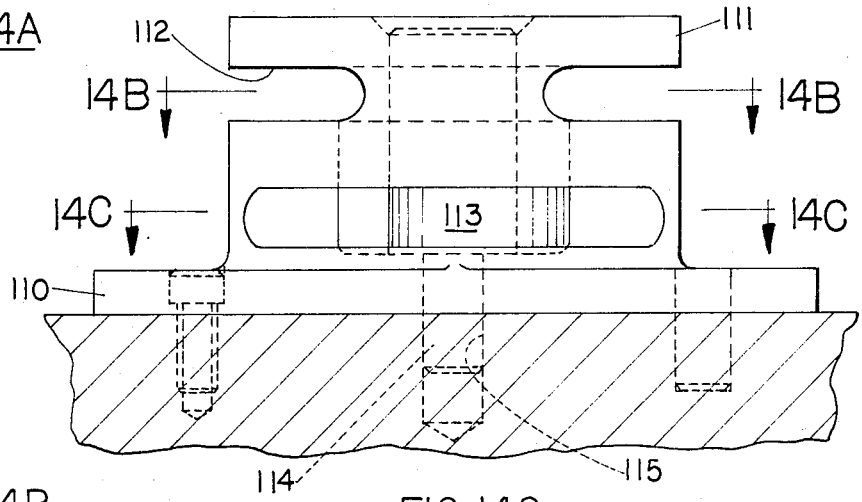
FIG. 14A is a side view of the resilient support means of FIG. 12.

FIG. 12 shows another embodiment of the resilient tool support means 12 of the present invention. Like the other resilient tool support means, this embodiment contains a flange area 110 and a base foundation portion 111. As best illustrated in FIGS. 12 and 14A, the resilient tool support means includes a plurality of arcuate grooves 112 in which pairs of grooves are in horizontal alignment with one another, while adjacent pairs of grooves are rotated 90° and spaced vertically from one another. The arcuate grooves 112 are cut into the side walls of the base portion 111 of the resilient tool support means to such an extent that the arcuate grooves communicate with the central bore. Like the resilient tool support means of the previous embodiment, this embodiment includes a central bore 19, but unlike the other embodiments of the present invention, the central bore 19 of this embodiment is of uniform diameter.

As illustrated in FIGS. 13, 14A, 14B and 14C, the flange area 110 of the resilient tool support means includes a plurality of openings and apertures to mount the resilient tool support means upon the press ram or stationary press bed as desired. Additionally, the base portion 111 of the resilient tool support means 12 includes a plurality of holes (not shown) positioned at the same location as shown with respect to other embodiments of the present invention, so as to provide means to mount either the upper or lower tooling member as desired.

Figure 14B:
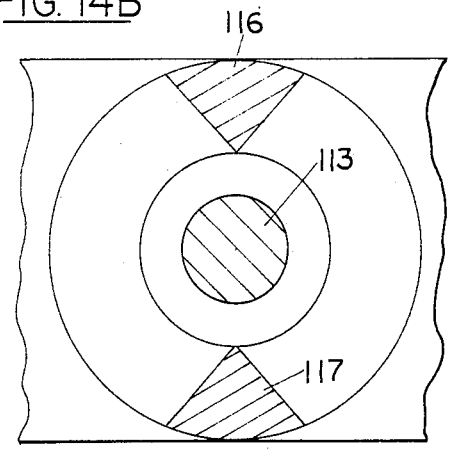
FIG. 14B is a cross-sectional top view taken along line 14B—14B of FIG. 14A.
Figure 14C:
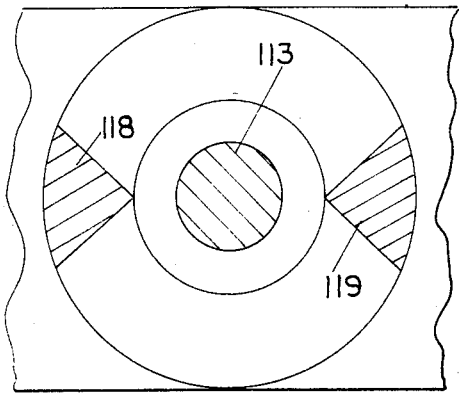
FIG. 14C is a cross-sectional top view taken along line 14C—14C of FIG. 14A.

In the preferred use of the resilient tool support means of FIGS. 12, 13, 14A, 14B and 14C, a positive stop 113 is meant to be positioned and mounted within the central bore 19 of the resilient tool support means 12 as shown part in phantom and part in solid line in FIG. 14A. The height of the positive stop, when properly positioned, is less than the height of the resilient tool support means. In this manner, the resilient tool support means 12 is capable of yielding until maximum deflection is achieved. At this point the resilient tool support means 12 will be the same height as the positive stop. At this point the resilient tool support means 12 will be the same height as the positive stop. Then, the positive stop 113 prevents the press (not shown) from collapsing or crushing the resilient tool support means 12. The stem portion 114 of the positive stop 113 extends through the flanged area 110 of the resilient tool support means into either the press ram or stationary press bed. Thus, in using this embodiment of the resilient tool support means 12, either the press ram or the stationary press bed must include a bore 115 into which the stem portion 114 of the positive stop 113 can extend. As illustrated in FIGS. 14B and 14C, two small pie-shaped members 116 and 117 or 118 and 119 remain after a pair of horizontal grooves 112 are cut into the side wall of the resilient tool support means. The pie-shaped members 116 and 117 or 118 and 119 are diametrically opposed to one another about the circumference of the central bore 19. The pairs of pie-shaped members 116 and 117 or 118 and 119 are spaced 90° from one another as best illustrated by comparing FIGS. 14B and 14C. This arrangement of the grooves 112 gives resiliency to the tool support means 12.

Figure 15:
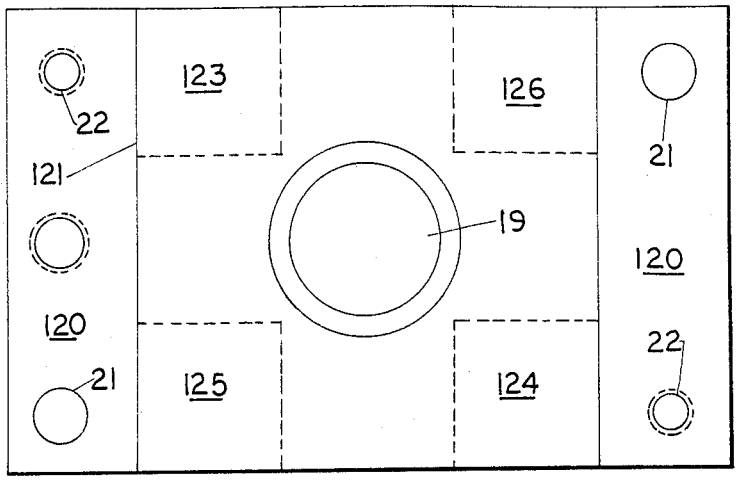
FIG. 15 is a plan view of another embodiment of a resilient tool support means.
Figure 16:
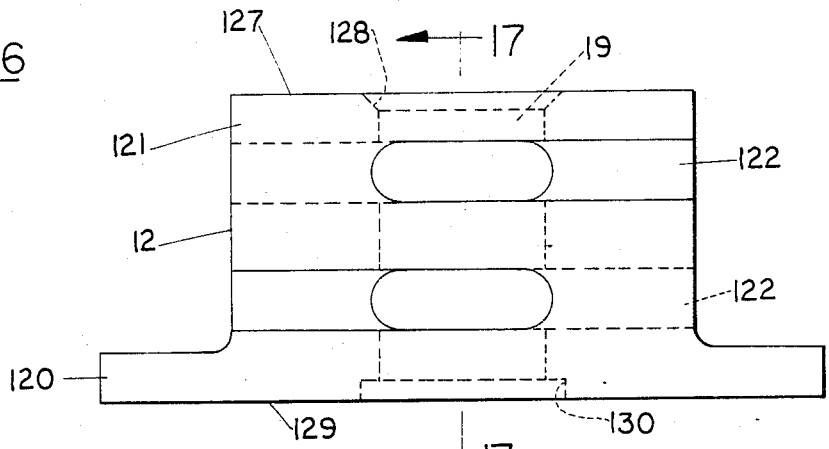
FIG. 16 is a side view of the resilient support means illustrated in FIG. 15.
Figure 17:
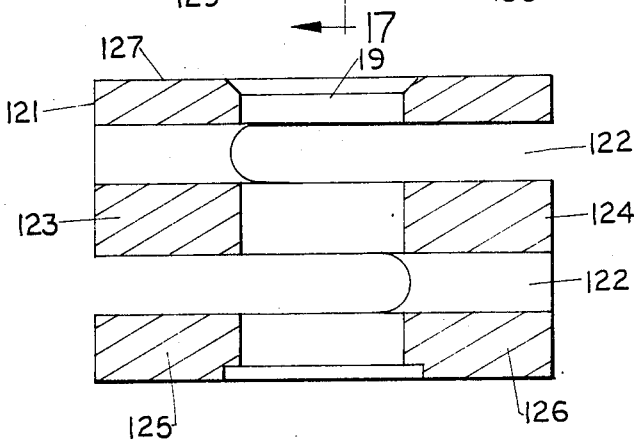
FIG. 17 is a cross-sectional side view taken along line 17—17 of the resilient support means of FIG. 16.

Another embodiment of the present invention illustrating another resilient tool support means 12 is shown in FIGS. 15, 16 and 17. This embodiment is similar in scope to the embodiment illustrated in FIGS. 12, 13, 14A, 14B and 14C and merely illustrate a square version of the circular resilient tool support means shown therein. The flanged area 120, as shown in FIG. 15, illustrates a plurality of openings 21 and apertures 22 for providing means to support and mount the resilient tool support means on either the press ram or the stationary press bed, in much the same manner as other embodiments of the present invention. In addition to the flanged area 120, the resilient support means of this embodiment also includes a base portion 121, which like other embodiments of the present invention, includes a central bore 19. Grooves 122 are cut into the side wall of the resilient tool support means leaving two opposed squares 123 and 124 or 125 and 126 remaining after the groove at each level has been cut, as best illustrated in FIG. 15.

The central bore 19 in the embodiment illustrated in FIGS. 15, 16 and 17 is shaped substantially similar to that of FIGS. 12, 13, 14A, 14B and 14C. In particular, the central bore 19 is uniform in diameter except near each end wherein the central bore has been expanded in size. The top end 127 of the resilient support means 12, shown in FIG. 16, illustrates the central bore 19 diverging outwardly so as to create a chamfered edge 128 at the top end 127 of the central bore. The opposite end 129 of the resilient tool support means 12 includes an enlarged step-type diameter opening 130.

Although the resilient tool support means of this embodiment can be employed without the use of a positive stop (not shown), the preferred use of the resilient tool support means is with a positive stop so that the resilient tool support means is capable of deflecting until it reaches a maximum, at which point the positive stop will prevent further deflection. In this manner, the resilient tool support means of FIGS. 15, 16 and 17 will uniformly yield to a given force, but will not totally collapse due to the positive stop.

The positive stop is shaped substantially similar to the central bore. In other words, the positive stop (not shown) includes a large diameter base foundation portion and a projecting portion which has a diameter slightly less than that of the resilient tool support means of this embodiment.

Modifications may be made in the invention without departing from the spirit of it.

What is claimed is:

1. In a press for performing a variety of operations for forming and making an easy open can end from stcok sheet material said press including a stationary press bed; a tooling base mounted upon said stationary press bed; a lower tooling member mounted upon said tooling base; a press ram overlying said stationary press bed; an upper tooling member suspended beneath said press ram, wherein said stationary press bed, said tooling base, and said upper and lower tooling members are in vertically alignment with one another, so that said operation may be performed upon an easy open can end by said press ram exerting a downward force on said upper tooling member, the improvement comprising a metallic resilent tool support means positioned between and secured to said press ram and said upper tooling member, said metallic resilient tool support means yielding to absorb any excess downward force of said press ram on said easy open can end, said tool support means includes a central bore and a positive stop mounted within the central bore of said resilient tool support means, said positive stop permitting said resilient tool support means to yield until maximum deflection is achieved and to prevent further yielding past maximum deflection.

2. The press of claim 1, wherein said resilient tool support means has a plurality of longitudinally spaced angularly aligned slots extending inwardly through the sides of said resilient tool support means.

3. The press as claimed in claim 2, wherein said plurality of slots comprises a first pair of diametrically opposed segmental slots longitudinally spaced from and aligned perpendicularly to said first pair of slots.

4. The press as claimed in claim 3, wherein said plurality of slots further includes a third pair of diametrically opposed segmental slots spaced from and aligned substantially parallel with said first pair of slots, said second pair of slots being positioned between said first and third pairs of slots.

5. The press as claimed in claim 2, wherein said resilient tool support means includes a central bore extending longitudinally therein, said plurality of slots extending into said bore.

6. The press as claimed in claim 5, wherein said central bore includes a small diameter bore, a large diameter bore, and an intermediate diameter bore, wherein said small, intermediate and large diameter bores are aligned with one another and extend completely through said resilient tool support means.

7. The press as claimed in claim 1, wherein said resilient tool support means includes a flange, said flange having means to secure said resilient tool support means to said press ram.

8. The press according to claim 7, wherein said flange is annularly shaped and is integrally attached to the upper circumference of said resilient tool support means.

9. The press as claimed in claim 8, wherein said means to align and secure said resilient tool support means to said press ram includes a plurality of orifices for accepting one or more studs or one or more bolts for aligning and securing said resilient tool support means to said press ram.

10. The press according to claim 9, wherein said resilient tool support means includes a central bore extending longitudinally therein, and a plurality of longitudinally extending openings which are spaced around said bore for accepting one or more studs or one or more bolts for aligning and securing said upper tooling member to said resilient tool support means.

11. The press of claim 1, wherein said resilient tool support means has a side wall and includes a pair of axial grooves cut into the side wall which are vertically spaced from one another.

12. The press of claim 1, wherein said central bore has an axial groove cut into the inner side wall of said resilient tool support means between the pair of outside grooves.

13. In a press for performing a variety of forming operations on an easy open can end from stock sheet material, said press including a stationary press bed, a lower tooling element mounted above said stationary press bed, a press ram overlying said stationary press bed, a tooling base suspended from said press bed, an upper tooling member suspended from said tooling base, wherein said stationary press bed, said upper and lower tooling members, and said tooling base are in alignment with said press rams, so that said operations may be performend upon an easy open can end by the downward force of said press ram, the improvement comprising the metallic resilient tool support means positioned between said stationary press bed and said lower tooling member, said metallic resilient tool support means being capable of deflecting to absorb excessive downward force of said press ram on said easy open can end, said resilient tool support means includes a central bore and a positive stop mounted within said central bore, said positive top mounted within said central bore, said positive stop permitting said resilient tool support means to yield until maximum deflection is achieved and to prevent further yielding past maximum deflection.

* * * * *